US009347309B2

(12) United States Patent
Raducanu et al.

(10) Patent No.: US 9,347,309 B2
(45) Date of Patent: May 24, 2016

(54) CEMENT PLUG LOCATION

(71) Applicant: WEATHERFORD TECHNOLOGY HOLDINGS, LLC, Houston, TX (US)

(72) Inventors: Marius Raducanu, College Station, TX (US); Yildirim Hurmuzlu, McKinney, TX (US); Sorin Gabriel Teodorescu, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 233 days.

(21) Appl. No.: 14/204,686

(22) Filed: Mar. 11, 2014

(65) Prior Publication Data

US 2014/0251603 A1 Sep. 11, 2014

Related U.S. Application Data

(60) Provisional application No. 61/775,906, filed on Mar. 11, 2013.

(51) Int. Cl.

| | |
|---|---|
| ***E21B 47/12*** | (2012.01) |
| ***E21B 47/09*** | (2012.01) |
| ***E21B 33/16*** | (2006.01) |

(52) U.S. Cl.

CPC ..... *E21B 47/09* (2013.01); *E21B 33/16* (2013.01); *E21B 47/12* (2013.01)

(58) Field of Classification Search

CPC ..... E21B 33/16; E21B 47/00; E21B 47/12; E21B 33/05; E21B 47/09

See application file for complete search history.

(56) References Cited

U.S. PATENT DOCUMENTS

| | | | |
|---|---|---|---|
| 2,999,557 | A | 9/1961 | Smith et al. |
| 4,468,967 | A | 9/1984 | Carter, Jr. |
| 6,585,042 | B2 | 7/2003 | Summers |
| 6,597,175 | B1 | 7/2003 | Brisco |
| 6,634,425 | B2 | 10/2003 | King et al. |
| 7,013,989 | B2 | 3/2006 | Hammond et al. |

OTHER PUBLICATIONS

International Search Report issued Feb. 5, 2015 for PCT Patent Application No. PCT/US14/023402, 3 pages.

Written Opinion issued Feb. 5, 2015 for PCT Patent Application No. PCT/US14/023402, 6 pages.

*Primary Examiner* — Zakiya W Bates

(74) *Attorney, Agent, or Firm* — Smith IP Services, P.C.

(57) ABSTRACT

The disclosure describes a system and a method for locating a cement plug within a wellbore. The system includes a signal transmitter mounted to the cement plug, a receiver at the opening to the wellbore, one clock positioned on the cement plug and in communication with the transmitter, a second clock which is synchronized to the first clock and in communication with the receiver, and a controller for triggering the transmittal of the signal.

19 Claims, 3 Drawing Sheets

CEMENT PLUG LOCATION

STATEMENTS REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A "SEQUENCE LISTING", A TABLE, OR A COMPUTER PROGRAM

Not applicable.

BACKGROUND

1. Technical Field

The disclosure relates to the field of cement plugs in oil and gas wellbores. More particularly, the present invention relates to an improved system for identifying the location of a cement plug and the like within a wellbore.

After drilling a hole into a desired location, a casing is inserted into the wellbore to stabilize the structure of the wellbore. Cementing is further required to adequately support the casing, provide zone isolation and prevent mixing of fluids. The process of cementing is well known in the art. After insertion of the casing into the wellbore, the casing is filled with drilling fluid or mud (hereinafter referred to as "drilling fluid"). A bottom cement plug containing a rupturable disk or diaphragm is then inserted into the casing. The bottom cement plug may also be referred to as a displacement plug. Cement slurry is pumped on top of the bottom plug to move the plug downwards and to displace the drilling fluid out of the casing and into the annulus between the casing and the wellbore rock. A top cement plug is then positioned on top of the cement slurry and additional drilling fluid is pumped into the casing to move the top cement plug, the cement slurry, and the bottom cement plug through the casing. Float equipment at the bottom of the casing prevents the bottom cement plug from further movement upon contact. With the combination of the continuous pumping of drilling fluid, this causes a build-up of pressure sufficient to breach the rupture disk within the bottom cement plug.

When the rupture disk is breached, the cement slurry moves through the bottom cement plug, the bottom end of the casing, and into the annulus between the casing and the wellbore rock. The top cement plug follows the cement slurry until it is stopped by the float equipment at the bottom of the casing. The subsequent pressure increase indicates that the top cement plug has reached the bottom of the casing and for the operating unit or personnel to cease pumping of the drilling fluid, thus ending the cementing operation.

Optimal cementing jobs rely on accurate identification of the location of the cement plugs. Cementing operations currently rely on volumetric displacement calculations to determine the location of the cement plugs. However, this method suffers from low accuracy due to factors including long casing strings, large diameter casing, and variable diameter within casings. Accurate identification of the location of the bottom cement plug is important to prevent over- and underdisplacement of the cement. Overdisplacement occurs when all the cement slurry is moved outside the casing and may result a cement deficiency around the bottom of the casing. Underdisplacement leaves cement within the casing which needs to be later removed. Both over- and underdisplacement require remedial operations which are often expensive and time consuming.

For reference to an existing description of cement plug location systems please see U.S. Pat. No. 2,999,557 "Acoustic Detecting and Locating Apparatus" (Smith), U.S. Pat. No. 4,468,967 "Acoustic Plug Release Indicator" (Carter), U.S. Pat. No. 6,585,042 "Cementing Plug Location System" (Summers), U.S. Pat. No. 6,634,425 "Instrumented Cementing Plug and System" (King), and U.S. Pat. No. 7,013,989 "Acoustical Telemetry" (Hammond) the disclosures of which are hereby incorporated by reference.

Prior disclosures of cement plug location systems, such as the patents described above, are not practical in an industrial setting, thus prompting a need for an improved system. Moreover, there is scant evidence that preexisting cement plug location systems are effective at the scale needed, or that they are used commercially in any significant measure. Some examples of such prior systems include: systems that rely on signals reflected over great distances; systems that rely on measuring hard wiring or cable, or using the wire or cable to transmit a signal; or systems which use a dual telemetry system. These prior systems suffer from problems such as: significant signal attenuation, cost inefficiency and/or physical impossibility at drill sites. As such, modern oil well drilling operations continue to use volumetric displacement calculations to determine the cement plug location, instead of implementing the aforementioned systems.

A need exists for an improved cement plug location system having increased accuracy and efficiency in a wellbore.

SUMMARY

The disclosure describes a system and a method for locating a cement plug within a wellbore. The system includes a signal transmitter mounted to the cement plug, a receiver at the opening to the wellbore, one clock positioned on the cement plug and in communication with the transmitter, a second clock which is synchronized to the first clock and in communication with the receiver, and a controller for triggering the transmittal of the signal.

The disclosure relates to a cement plug location system which addresses the shortcomings of previous systems. The disclosed system utilizes a modified time of flight method which minimizes processing time and signal attenuation. The classic time of flight method consists of transmitting a signal from the top of the wellbore to the cement plug and back and measuring the total time. The "total time" constitutes the time required for the signal to reach the cement plug, and the time required for the signal to return from the cement plug to the top of the wellbore. Because of the constraints involved in oilfield wells, the classic time of flight method suffers from significant signal attenuation because the signal must travel the lengthy distance between the two points twice.

The method described in this disclosure synchronizes two clocks, one on a system near the top of the wellbore and one on the cement plug. The synchronization of the two clocks is critical to the success and accuracy of the disclosed method. The time of flight under the disclosed method is the travel time of the signal from the cement plug to the top of the wellbore. Thus, the signal only needs to travel the distance between the two points once. There is no need to reflect the signal, nor is there excess processing time. As the clocks are synchronized, the time of flight can be determined with a high degree of precision, and the distance easily calculated through the following equation: $d=V_f*\Delta t$, where d is the distance, $V_f$ represents the velocity of the signal through the medium or fluid f in which it is traveling, and Δt is the time of flight. The disclosed method results in a measurement which can accurately locate a cement plug to within one foot (approximately thirty centimeters) or less. On the other hand, currently used volumetric displacement calculations, may have results that range from ten to twenty feet (approximately three to six meters) of the actual location of the cement plug. In addition to identifying the location of a cement plug, this disclosure can also identify washouts, corrosion related issues, and other problems encountered down hole as well as verify volumetric displacement calculations.

As used herein, the term "transmitter" includes any device which is capable of communicating signal(s) or wave(s) from one point to another, and in addition, may also be a source of, or produce signal(s) or wave(s) itself. As used herein, the signal may be acoustic, heat, pressure, visual, or any other suitable sign or data form capable of being transmitted and may be the result of a chemical reaction, a sound wave, an electromagnetic wave, a mechanical action, or any other suitable process. The signal produced may be a pulse. It is to be understood, however, that the signal cannot be coded or modulated. Example embodiments of transmitters which may be implemented into various embodiments of the system include firing mechanisms that would fire a bullet-like object or that trigger energy stored as chemical energy or battery.

As used herein, the term "medium" (except when referring to the computer program) includes any fluids or liquids used in drilling operations, casing material (wherein the term "casing material" or "casing" includes, but is not limited to liner hangers, subsea casing hanger running tools, running strings of drill pipe, and common casing), void space or vacuum, geologic formations surrounding the wellbore, or any combination of the foregoing.

BRIEF DESCRIPTION OF THE FIGURES

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION OF THE PREFERRED EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
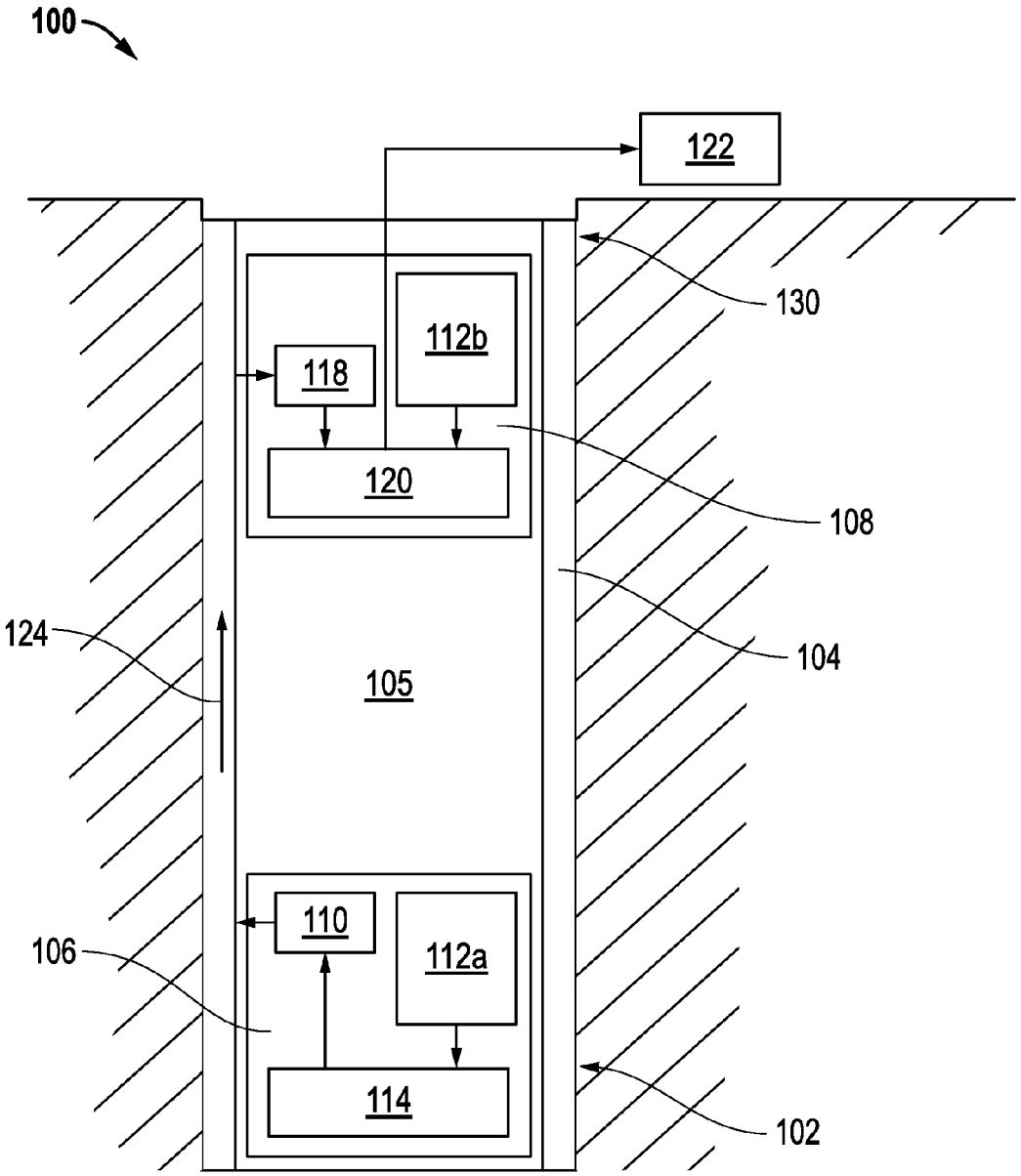
FIG. 1 depicts a schematic view of a wellbore and cement plug location system according to an embodiment.

FIG. 1 depicts an exemplary schematic view of a drill site 100 having a wellbore 102 lined with a casing 104. The wellbore 102 may be formed in the earth or seafloor and has a top system 108 near the wellbore 102 opening. Within casing 104 is a cement plug 106. Furthermore, the casing 104 may also have a fluid 105 above and/or below the cement plug 106. The fluid 105 may be any fluid mixture used in drilling operations, including drilling fluid or drilling mud or cement or cement slurry. The cement plug 106 is down hole from the top system 108 and is movable within the casing 104. Cement plug 106 may be a top plug 106*a* and/or a bottom cement plug 106*b* (which may contact a shoe 107). Further, as shown, a transmitter 110, a clock 112*a*, and a controller 114 are mounted on cement plug 106. The transmitter 110, clock 112*a*, and controller 114 are engaged together and configured to enable communication between those elements. The top system 108 consists of a receiver 118, a clock 112*b*, a processor 120 and a display 122. The receiver 118, clock 112*b*, processor 120, and display 122 are engaged together and configured to enable communication between those elements.

The controller 114 and/or processor 120 may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computer system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., hard disk); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments of controller 114 and/or processor 120 may be embodied in an electrical, optical, acoustical or other form of propagated signal (e.g., carrier waves, infrared signals, digital signals, etc.), or wire line, wireless, or other communications medium.

Computer program code for carrying out operations of the embodiments may be written in any combination of one or more programming languages, including an object oriented programming language such as Java, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (for example, through the Internet using an Internet Service Provider).

The embodiments shown are used for calculating the distance traveled by a signal (represented by a line 124) through the casing 104 or fluid 105 based on the time of flight of the signal 124. In the embodiment, it is critical that clock 112*a* on cement plug 106 is initially synchronized to clock 112*b* at the top system 108 located at the top of the wellbore 130. The synchronization of clock 112*a* and clock 112*b* enable a precise measurement of the change in time and thus the identification of the distance between the cement plug 106 and the top of the wellbore 130 for time of flight calculations (the time of flight calculations are further described in paragraphs below). In addition, the clocks 112*a* and/or 112*b* may be battery-powered in certain embodiments. To begin, the operator of drill site 100 or the processor 120 inputs into controller 114 one or more times for the release or trigger of the signal 124. At the predetermined time or times on clock 112*a*, the controller 114 communicates to transmitter 110 to produce and send a signal 124 to the top of the wellbore 130. The time of trigger or release of signal 124 may be at any point during the cementing operation. For example, but not limited to, the signal 124 may be triggered before the rupture disk on the cement plug 106 is breached; the signal 124 may be triggered after the cement is displaced out into the annulus between the wellbore 102 and the casing 104; and/or the signal 124 could be sent at various established intervals (e.g. an established interval of every ten seconds, twenty seconds, ten minutes, or twenty minutes). While only one transmitter 110 and one signal 124 are shown in the embodiment in FIG. 1, it is to be appreciated that multiple transmitters 110 and multiple signals 124 may be used, and that the times for triggering a signal or signals 124 may be repeated at set intervals. Further, the signal 124 may travel through the casing 104 itself (as seen in FIG. 1), a fluid 105 within casing 104, through the geologic formations surrounding wellbore 102, or any combination of the foregoing. For example, but not limited to, the transmitter 110 may be a bullet-type fired into the casing 104 wall, thereby creating a pulse or signal 124. In another example, two transmitters 110 may be implemented with one bullet-type transmitter 110 creating a signal through the wall of casing 104 and a second transmitter 110 creating an acoustic signal 124 traveling through the fluid 105.

The receiver 118 at the top of the wellbore 130 accepts the signal 124 and then communicates the data to processor 120. The processor 120 records the time that signal 124 was received based on synchronized clock 116. The processor 120 then calculates the exact time of flight traveled by signal 124 by the difference in the time that the signal 124 was set to be sent by transmitter 110, and the time the signal 124 was collected by receiver 118. Based on standardized knowledge of the velocity of the signal 124 through the medium through which the signal 124 travels, such as the casing 104 or the fluid 105, and accounting for temperature variables at drill site 100, the processor 120 can determine or deduce the distance traveled by signal 124 between the cement plug 106 and the top system 108. The distance traveled by signal 124 represents the location of cement plug 106 at the time of transmittal. Further, a display 122 may be connected to processor 120 as an interface to present the results, or for an operator of drill site 100 to manipulate processor 120.

Figure 2:
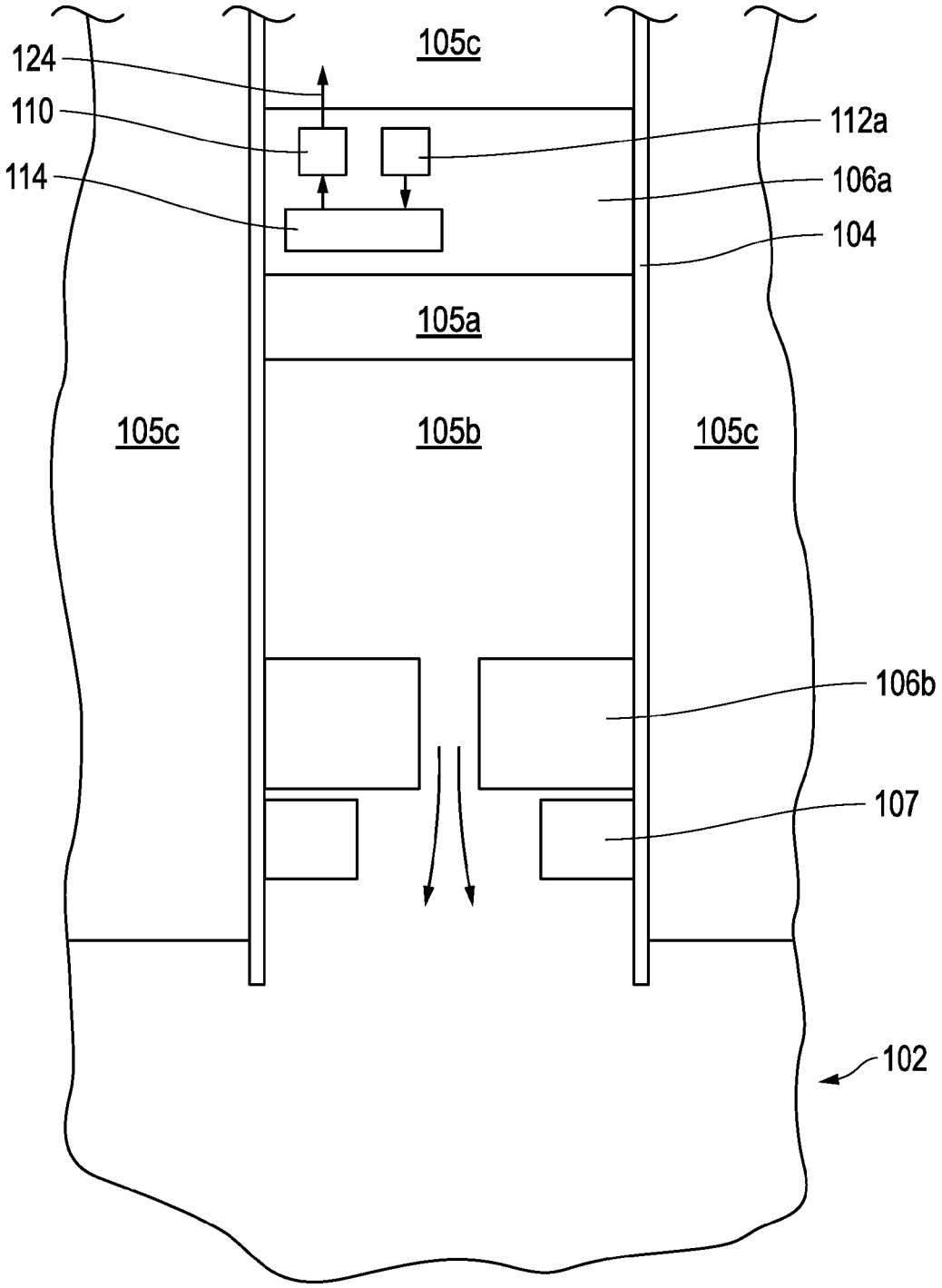
FIG. 2 depicts a schematic wellbore with two cement plugs and a shoe in another embodiment.

In another embodiment, FIG. 2 depicts a schematic wellbore 102 with two cement plugs 106*a* and 106*b* and a shoe 107. In the embodiment, the bottom cement plug 106*b* has reached the bottom of the casing 104 where the shoe 107 is located. The shoe 107 stops the bottom cement plug 106*b* from further progressing along the casing 104. The pressure causes the rupture disk (not shown) within bottom cement plug 106*b* to collapse. Then the cement 105*b* flows through the bottom cement plug 106*b* where the rupture disk had been breached. The shoe 107, as seen, has an aperture that allows cement 105*b* to flow through after passing the bottom cement plug 106*b*. The operator of drill site 100 or processor 120 continues to pump drilling mud 105*c* through the casing 104, thus pushing cement plug 106*a* down and moving cement 105*b* through the bottom cement plug 106*b* and through the shoe 107 into the annulus between the wellbore 102 and the casing 104. Cement plug 106*a* contains transmitter 110, clock 112*a*, and controller 114. While the transmitter 110, clock 112*a* and controller 114 are located on cement plug 106*a*, the top cement plug, in the embodiment of FIG. 2, it is to be appreciated that the transmitter 110, clock 112*a*, and controller 114 may also be located on cement plug 106*b*, the bottom cement plug, or both in plural. In the embodiment shown in FIG. 2, the signal (represented by line 124) is transmitted by cement plug 106*a* through the drilling mud 105*c*.

Further, in certain embodiments, and demonstrated in FIG. 2, a vacuum or low pressure region 105*a* may exist when the casing 104 is not filled with fluid 105, which can happen when cement plug 106 free-falls during displacement, creating a vacuum 105*a*.

At least one preferred embodiment of the proposed innovative method and/or system for calculation of the distance is presented in Algorithm 1 and/or Algorithm 2 below. Algorithm 1 is a simple method to calculate the distance function of time of flight when ΔT is known. Algorithm 2 is a method to calculate the distance when ΔT is unknown. Those skilled in the art may recognize that variations of and additions to these algorithms are possible. By way of example only, the effects of temperature variation on the velocity of the signal may be compensated for via temperature measurements and additions or variations to the algorithm.

Algorithm 1 a. Finding the difference in time, Δt, between the time of trigger of a signal, $t_1$, and the time of reception of the signal, $t_2$: $\Delta t = t_2 - t_1$.
b. Determining velocity of the signal through the medium, V, where $V_T$ is the velocity of the signal in the medium at temperature T; K is a constant based on the properties of the medium; and ΔT is the difference between the temperature of the known velocity in the medium, $V_T$, and the average temperature of the bore (top to downhole): $V = V_T + K * \Delta T$.
c. Solving for distance, d: $d = V * \Delta t$.

Algorithm 2 below solves for d in situations where the temperature, ΔT, is not known. While the coefficient $K_m$ may be known in the literature for certain media, such as steel, the coefficient $K_m$ may not be known for other media, for example, but not limited to, drilling fluid or drilling mud, which may be complex mixtures of water, oils, air, and other liquids or solids. Where the coefficient $K_m$ is unknown, it may be solved theoretically or determined experimentally for the particular medium through techniques known to those skilled in the art. Algorithm 2 utilizes at least two signals and the following equations to solve for d, assuming little knowledge of the coefficient for the media in which the signals travel. By way of example only, the following embodiment for an algorithm which may be implemented shows a signal traveling through the casing, c, as the first possible medium, and another signal traveling through the drilling fluid, f, as another possible medium. The time of trigger of the signals, $t_1$, is the same for both signals.

Algorithm 2 a. For a signal traveling through casing, c, we have the following set of equations:
   i. $\Delta t_c = t_{2c} - t_1$, where $\Delta t_c$ is the difference in time between the time of trigger of a signal through a casing, $t_1$, and the time of reception of the signal, $t_{2c}$;
   ii. $V_c = V_{cT} + K_c * \Delta T$ where $V_c$ is the velocity of the signal in the casing, $V_{cT}$ is the velocity of the signal in the casing at temperature T; $K_c$ is a constant based on the properties of the casing; and ΔT is the difference between the temperature of the known velocity in the casing, $V_{cT}$, and the average temperature of the bore (top to downhole); and iii. $d=V_c*\Delta t_c$, where d is the distance between the location where signal is received and where the signal was triggered.

b. For a signal traveling through drilling fluid, f, we have the following set of equations:

i. $\Delta t_f=t_{2f}-t_1$ where $\Delta t_f$, is the difference in time between the time of trigger of a signal through a drilling fluid, $t_1$, and the time of reception of the signal, $t_{2f}$;

ii. $V_f=V_{fT}+K_f*\Delta T$ where $V_f$ is the velocity of the signal in the drilling fluid, $V_{fT}$ is the velocity of the signal in the drilling fluid at temperature T; $K_f$ is a constant based on the properties of the drilling fluid; and ΔT is the difference between the temperature of the known velocity in the drilling fluid, $V_{fT}$, and the average temperature of the bore (top to downhole) (it is to be understood that in the case of sound that the speed of sound is a function of density, pressure, adiabatic coefficient, or Young's module for solids; and that all of the foregoing vary with the temperature; and in this case, the speed of sound is a non-linear function with the temperature but by applying Taylor expansion it could be approximated as linear for a two hundred centigrade range in this case); and iii. $d=V_f*\Delta t_f$ where d is the distance between the locations where signal is received and where the signal was triggered.

c. Determining $K_c$ and $K_f$ through literature or calculations (if known), or experimentally through techniques known to those skilled in the art. By way of example, in the case of drilling mud, the coefficient should be determined experimentally for each particular type of drilling mud because drilling mud is typically a mixture of at least water, oil, air plus other component(s).

d. Finding the difference in time, $\Delta t_c$, between the time of trigger of a signal through a casing, $t_1$, and the time of reception of the signal, $t_{2c}$.

e. Finding the difference in time, $\Delta t_f$, between the time of trigger of a signal through a drilling fluid, $t_1$, and the time of reception of the signal, $t_{2f}$.

f. Solving the above two sets of equations as a linear system of six unknowns, $\Delta t_c$, $\Delta t_f$, $V_c$, $V_f$, ΔT, and d with knowledge of $t_1$, $t_{2c}$, $t_{2f}$, $V_{cT}$, $V_{fT}$, $K_c$, and $K_f$ with the purpose of identifying d.

Figure 3:
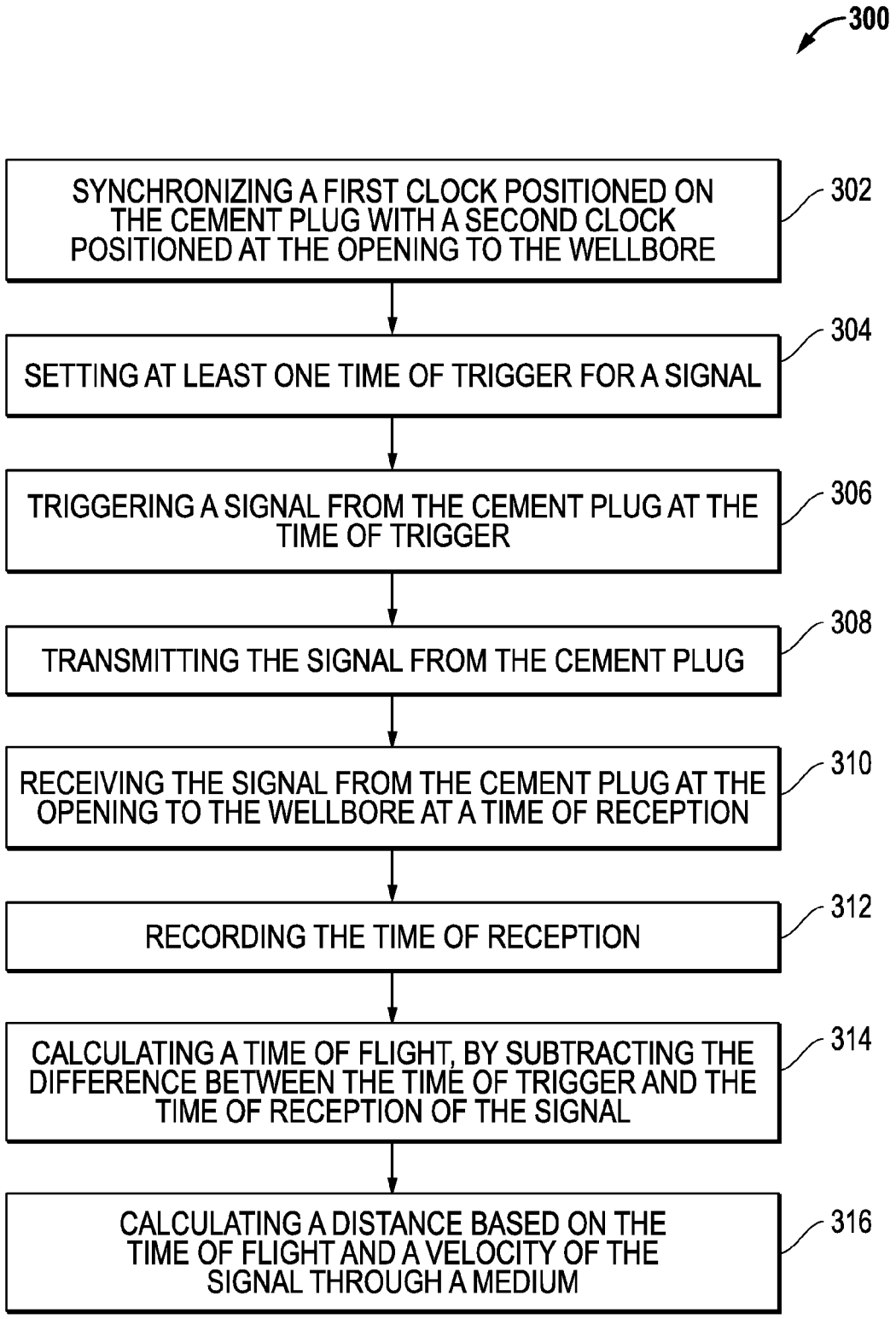
FIG. 3 depicts a flowchart illustrating a method of using the cement plug location system in an embodiment.

FIG. 3 is a flowchart illustrating a method 300 of using the cement plug location system in an embodiment. The flow starts at block 302 where a clock 112*a* positioned on the cement plug 106 is synchronized to another clock 112*b* at the top of the wellbore 130 (the synchronization of clock 112*a* to clock 112*b* is critical to the methodology). The flow then continues at block 304, where the operator of the drill site 100 or a processor 120 will set at least one time of trigger for a signal 124. The flow then continues at block 306, where a signal 124 is triggered from the cement plug 106 at the predetermined trigger time. The flow then continues at block 308, where the signal 124 is transmitted from the cement plug 106. It should be appreciated that steps within block 306 and block 308 may also occur simultaneously, that is, that the signal 124 may be both triggered and transmitted at the same time, in addition to the option of occurring in sequence. The flow then continues at block 310, where the signal 124 is received from a receiver 118 at the top of the wellbore 130 at a time of reception. The flow then continues at block 312 where the time of reception is recorded. The flow then continues at block 314 where the time of flight is calculated by finding the difference between the time of trigger and the time of reception of the signal 124. The flow then continues at block 316 where the distance between the cement plug 105 and the top of the wellbore 130 is determined based on the time of flight and a known velocity of the signal through the medium traveled. The steps of method 300 may be repeated as needed to obtain multiple distances for the purposes of comparison and increasing accuracy.

While the embodiments are described with reference to various implementations and exploitations, it will be understood that these embodiments are illustrative and that the scope of the inventive subject matter is not limited to them. Many variations, modifications, additions and improvements are possible. For example, prior techniques for locating a cement plug via measuring volume pumped and volume remaining of fluid may be correlated or combined with the present disclosure and accounted for in any algorithm. Additionally, the disclosure herein may also be used to communicate the downhole status of, for example, whether a valve is open or closed.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A system for locating a cement plug within a wellbore with at least one opening, comprising:

a transmitter for transmitting a signal, wherein the transmitter is mounted to the cement plug;

a receiver for receiving the signal, wherein the receiver is positioned proximate the opening to the wellbore;

a first clock positioned on the cement plug and in communication with the transmitter;

a second clock in communication with the receiver, wherein the first clock is configured to be synchronized to the second clock; and a controller for triggering the signal, wherein the controller is in communication with the transmitter and the first clock.

2. The system as claimed in claim 1, wherein the signal is a chemical reaction.

3. The system as claimed in claim 1, wherein the signal is acoustic.

4. The system as claimed in claim 1, further comprising a processor in communication with the receiver configured for processing the signal and calculating a distance to the cement plug.

5. The system as claimed in claim 1, wherein the transmitter is configured to transmit a synchronous second signal; and further comprising a second receiver for receiving the second signal, wherein the second receiver is positioned proximate the opening to the wellbore.

6. The system as claimed in claim 1, further comprising a second transmitter configured to transmit a synchronous second signal; and further comprising a second receiver for receiving the second signal, wherein the second receiver is positioned proximate the opening to the wellbore.

7. A system for locating a cement plug within a wellbore filled with a fluid and lined with a casing with at least one opening, comprising:

a transmitter for transmitting a signal, wherein the transmitter is mounted to the cement plug;

a receiver for receiving the signal, wherein the receiver is positioned proximate the opening to the wellbore;

a first clock positioned on the cement plug and in communication with the transmitter;

a second clock in communication with the receiver, wherein the first clock is configured to be synchronized to the second clock;

a controller for triggering the signal, wherein the controller is in communication with the transmitter and the first clock; and a processor in communication with the receiver configured for processing the signal and calculating a distance to the cement plug.

8. The system as claimed in claim 7, wherein the signal is transmitted through the casing.

9. The system as claimed in claim 7, wherein the signal is transmitted through the fluid.

10. The system as claimed in claim 7, wherein the transmitter transmits the signal through the casing;

further comprising a second transmitter for transmitting a synchronous second signal through the fluid; and further comprising a second receiver for receiving the second signal, wherein the second receiver is positioned proximate the opening to the wellbore.

11. The system as claimed in claim 7, wherein the signal is transmitted through the casing and through the fluid; and further comprising a second receiver positioned proximate the opening to the wellbore.

12. A method for locating a cement plug within a wellbore, comprising the steps of:

(a) synchronizing a first clock positioned on the cement plug with a second clock positioned at an opening to the wellbore;

(b) setting at least one time of trigger for a signal;

(c) triggering a signal from the cement plug at the time of trigger;

(d) transmitting the signal from the cement plug;

(e) receiving the signal from the cement plug proximate the opening to the wellbore at a time of reception;

(f) recording the time of reception;

(g) calculating a time of flight, based at least in part on the difference between the time of trigger and the time of reception of the signal; and (h) calculating a first distance based on the time of flight and a velocity of the signal through a medium.

13. The method as claimed in claim 12, further comprising the step of calculating the velocity of the signal through the medium based on the temperature of the medium and a constant.

14. The method as claimed in claim 12, further comprising of (a) repeating the method steps (c) through (h) to obtain a second distance; and (b) averaging the first distance and the second distance for the purposes of increasing the accuracy of the method.

15. The method as claimed in claim 12, wherein said step of setting at least one time of trigger for a signal comprises setting the time of trigger for 10 seconds.

16. The method as claimed in claim 15, wherein said step of setting the at least one time of trigger for 10 seconds further comprises of repeating the time of trigger for every subsequent 10 second period.

17. The method as claimed in claim 12, wherein said step of triggering the signal comprises triggering two synchronous signals from the cement plug;

wherein said step of calculating the time of flight comprises calculating the time of flight based at least in part on the difference between the time of trigger and the time of reception of the two respective signals; and wherein said step of calculating the first distance comprises calculating the first distance based on the respective time of flight and the velocity of the two signals through at least one medium.

18. The method as claimed in claim 17, wherein said step of transmitting the signal from the cement plug comprises transmitting a first of the two synchronous signals through a casing and transmitting a second of the two synchronous signals through a fluid.

19. The method as claimed in claim 12, wherein said step of receiving the signal from the cement plug comprises receiving the signal both through a casing and through a fluid.

* * * * *